US009788109B2

(12) United States Patent
Lu et al.

(10) Patent No.: US 9,788,109 B2
(45) Date of Patent: Oct. 10, 2017

(54) MICROPHONE PLACEMENT FOR SOUND SOURCE DIRECTION ESTIMATION

(71) Applicant: Microsoft Technology Licensing, LLC, Redmond, WA (US)

(72) Inventors: Youhong Lu, Redmond, WA (US); Chun Beng Goh, Bellevue, WA (US); Douglas L. Beck, Bothell, WA (US); Jia Hua, Redmond, WA (US); Ilya Khorosh, Seattle, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 14/848,703

(22) Filed: Sep. 9, 2015

(65) Prior Publication Data

US 2017/0070814 A1 Mar. 9, 2017

(51) Int. Cl.
*H04R 3/00* (2006.01)
*H04R 29/00* (2006.01)
(Continued)

(52) U.S. Cl.
CPC ..... *H04R 3/005* (2013.01); *H04R 1/406* (2013.01); *H04R 29/005* (2013.01); *H04R 5/027* (2013.01);
(Continued)

(58) Field of Classification Search
CPC ..... H04R 3/005; H04R 1/406; H04R 29/005; H04R 2410/01; H04R 2430/20;
(Continued)

(56) References Cited

U.S. PATENT DOCUMENTS 6,069,961 A 5/2000 Nakazawa
7,158,645 B2 1/2007 June et al.
(Continued)

FOREIGN PATENT DOCUMENTS

CN 201765319 U 3/2011
JP 2007052373 A 3/2007
WO 2014147442 A1 9/2014

OTHER PUBLICATIONS

Bitwave PTE. LTD., "Directional Finding Array Technology", Published on: Mar. 2, 2012, Available at: http://www.bitwave.com.sg/Technology/Directional_FA.php.
(Continued)

*Primary Examiner* — Vivian Chin
*Assistant Examiner* — Friedrich W Fahnert
(74) *Attorney, Agent, or Firm* — Lyon & Harr, LLP; Katrina A. Lyon

(57) ABSTRACT

Architectures of numbers of microphones and their positioning in a device for sound source direction estimation and source separation are presented. The directions of sources are front, back, left, right, top, and bottom of the device, and can be determined by amplitude and phase differences of microphone signals with proper microphone positioning. The source separation is to separate the sound coming from different directions from the mix of sources in microphone signals. This can be done with blind source separation (BSS), independent component analysis (ICA), and beamforming (BF) technologies. The device can perform many kinds of audio enhancements for the device. For example, it can perform noise reduction for communications; it can choose a source from a desired direction to perform speech recognition; and it can correct sound perceiving directions in microphones and generate desired sound images like stereo audio output. In addition, with source separation, 2.1, 5.1,
(Continued)

7.1, and other audio encoding and surround sound effects can be straightforward.

20 Claims, 12 Drawing Sheets

(51) Int. Cl.
*H04R 1/40* (2006.01)
*H04R 5/027* (2006.01)

(52) U.S. Cl.
CPC .. *H04R 2201/401* (2013.01); *H04R 2201/405* (2013.01); *H04R 2410/01* (2013.01); *H04R 2430/20* (2013.01); *H04R 2499/11* (2013.01); *H04S 2400/15* (2013.01)

(58) Field of Classification Search
CPC ..... H04R 5/027; H04R 2201/401; H04R 2201/405; H04R 2499/11; H04S 2400/15
USPC ..... 381/18, 26, 56, 92, 303, 355
See application file for complete search history.

(56) References Cited

U.S. PATENT DOCUMENTS

| | | | | |
|---|---|---|---|---|
| 7,877,125 | B2 | 1/2011 | Takizawa et al. | |
| 7,970,609 | B2 | 6/2011 | Hayakawa | |
| 8,428,286 | B2 | 4/2013 | Fueldner et al. | |
| 8,577,677 | B2 | 11/2013 | Kim et al. | |
| 8,886,526 | B2 | 11/2014 | Yoo et al. | |
| 2003/0160862 | A1 | 8/2003 | Charlier et al. | |
| 2005/0239516 | A1 | 10/2005 | Gonopolskiy | |
| 2008/0317260 | A1 | 12/2008 | Short | |
| 2011/0317041 | A1 | 12/2011 | Zurek et al. | |
| 2013/0315402 | A1 | 11/2013 | Visser et al. | |
| 2014/0166390 | A1* | 6/2014 | Center | H04R 1/02 181/199 |
| 2014/0219471 | A1* | 8/2014 | Deshpande | H04R 3/005 381/92 |
| 2014/0241529 | A1* | 8/2014 | Lee | H04R 5/027 381/26 |
| 2014/0241549 | A1* | 8/2014 | Stachurski | H04M 3/568 381/92 |
| 2015/0036848 | A1* | 2/2015 | Donaldson | H04S 7/303 381/303 |
| 2015/0078555 | A1 | 3/2015 | Zhang et al. | |
| 2015/0110275 | A1 | 4/2015 | Tammi et al. | |
| 2015/0125011 | A1 | 5/2015 | Sekiya | |

OTHER PUBLICATIONS

Islam, et al., "Comparing Dual Microphone System with Different Algorithms and Distances between Microphones", In Master Thesis, May 2013, 64 pages.

"International Search Report and Written Opinion Issued in PCT Application No. PCT/US2016/045455", Mailed Date: Feb. 9, 2017, 19 Pages.

Second Written Opinion Issued in PCT Application No. PCT/US2016/045455, dated: Jun. 8, 2017, 6 pages.

* cited by examiner

MICROPHONE PLACEMENT FOR SOUND SOURCE DIRECTION ESTIMATION

BACKGROUND

Modern electronic devices including monitors, laptop computers, tablet computers, cell phones, or any devices and systems having audio capability use at least one microphone to pick up audio. Depending on the balance between complexity and cost, electronic devices having audio capability typically use one to four microphones. When more microphones are used in a device audio performance like noise reduction, sound source separation, and audio output enhancement increases. On the other hand, when more microphones are used the cost of manufacturing and audio processing complexity also increases.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

The microphone placement implementations described herein present microphone positioning architectures in a device with smallest number of microphones to determine maximum number of source directions. These microphone placement implementations provide for architectures of numbers of microphones and their positioning in a device for determining sound source direction estimation and source separation which can be used for various audio processing purposes.

In one exemplary microphone placement implementation, an electronic device having audio capability employs a process that uses located sound sources relative to a device to prepare outputs which are input into an application. This process involves receiving microphone signals of the sound received from two or more microphones. Sound source locations are determined relative to the device using the placement of the two or more microphones on the surfaces of the device and time of arrival and amplitude differences of sound received by the microphones. The space around the device is divided into partitions using the determined sound source locations. Additionally, the number and type of applications for which the microphone signals are to be used and the number and type of output signals needed are determined. The determined partitions are used to select and process the microphone signals from desired partitions to approximately optimize signals for output for the one or more applications.

The microphone placement implementations described herein can have many advantages. For example, they can provide for the determination of the maximum number of sound source directions using the smallest number of microphones. They can also use the determined sound source directions to optimize, or approximately optimize, outputs for various audio processing applications, such as, for example, reducing noise in a communications application, performing sound source separation and noise reduction in a speech recognition application, correcting incorrectly perceived sound source directions in an audio recording, and more efficiently encoding audio signals. Since the smallest number of microphones can be used to determine the sound source directions and optimize the output, electronic devices can be made smaller and less expensively. Furthermore, in some applications, the complexity of the audio processing can be reduced, thereby increasing the computing efficiency for signal processing of the input microphone signals.

DESCRIPTION OF THE DRAWINGS

The specific features, aspects, and advantages of the disclosure will become better understood with regard to the following description, appended claims, and accompanying drawings where:

DETAILED DESCRIPTION

Figure 1:
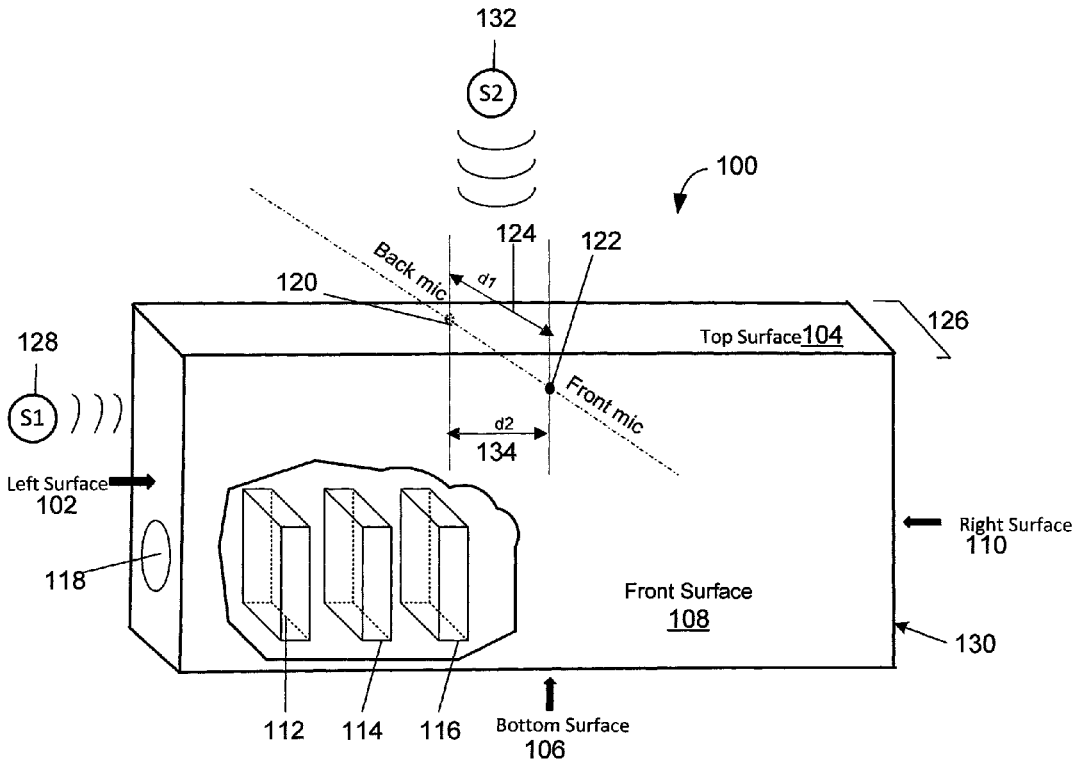
FIG. 1 is a depiction of an electronic device with microphones placed on the front and back surfaces of the device.

In the following description of microphone placement implementations, reference is made to the accompanying drawings, which form a part thereof, and which show by way of illustration examples by which implementations described herein may be practiced. It is to be understood that other embodiments may be utilized and structural changes may be made without departing from the scope of the claimed subject matter.

1.0 Microphone Placement Implementations

The following sections provide an overview of the microphone placement implementations described herein, as well as exemplary devices, systems and processes for practicing these implementations.

As a preliminary matter, some of the figures that follow describe concepts in the context of one or more structural components, variously referred to as functionality, modules, features, elements, etc. The various components shown in the figures can be implemented in any manner. In one case, the illustrated separation of various components in the figures into distinct units may reflect the use of corresponding distinct components in an actual implementation. Alternatively, or in addition, any single component illustrated in the figures may be implemented by plural actual components. Alternatively, or in addition, the depiction of any two or more separate components in the figures may reflect different functions performed by a single actual component.

Other figures describe the concepts in flowchart form. In this form, certain operations are described as constituting distinct blocks performed in a certain order. Such implementations are illustrative and non-limiting. Certain blocks described herein can be grouped together and performed in a single operation, certain blocks can be broken apart into plural component blocks, and certain blocks can be performed in an order that differs from that which is illustrated herein (including a parallel manner of performing the blocks). The blocks shown in the flowcharts can be implemented in any manner.

1.1 Background

Microphone positioning is essential for determining the direction of sound sources. Sound source directions can be defined as coming toward the front, back, left, right, top, and bottom surfaces of the device. When all microphones have identical performance and are placed in a front surface of a device (known as broadside), one cannot determine if a sound source is coming from a direction in front of the device or from a direction from the back the device. Another example is when microphones have identical performance and are placed vertically from front to back (known as end-fire). In this configuration, it cannot be determined if the source is from the left or from the right direction.

Audio devices and systems usually have electronic circuits to receive audio signals and to convert analog signals into digital signals for further processing. They have microphone analog circuits to transfer audio sound to analog electrical signals. In digital microphone cases, the microphone analog circuit is included in the microphone set. These digital microphones have analog to digital (A/D) converters to convert an analog signal to digital signal samples with a sampling rate $F_s$ and a number of bits N for each sample.

Devices and systems with audio capability usually have digital signal processors (DSP) or other digital signal processing hardware. With the help of DSP, many modern digital signal processing algorithms for audio can be implemented in DSP hardware. For example, the number of sound sources and direction of the sound sources can be determined via proper audio processing algorithms in a beamforming (BF) field. Sound source separation becomes feasible with powerful DSP where many advanced audio processing algorithms can be implemented in DSP. These algorithms include blind source separation (BSS), independent component analysis (ICA), principal component analysis (PCA), nonnegative matrix factorial (NMF), and BF.

A device usually has an Operating System (OS) running on a Central Processing Unit (CPU) or Graphics Processing Unit (GPU). All signal processing can be done with on the OS using an application or App. For example, audio processing can be implemented using an Audio Processing Object (APO) with an audio driver.

In order for these algorithms to work effectively, proper microphone positioning is needed although there are many ways to position microphones in a device. For example, when two microphones are used, both can be embedded in a front surface of a device, both can be embedded in back surface, both can be in the top surface, both can be in either side surface, one can be in front and the other can be in back, one can be in front and the other can be in top, one can be in back and the other can be in top, and so forth. There are three important considerations in the choice of positioning: available space for a microphone in the device housing due to different sizes and types of devices, placing the microphone(s) far away from loudspeakers for reducing acoustic coupling, and positioning of the microphones to determine a greater number of sound source directions.

1.2 Overview

In this disclosure, microphone placement implementations are presented that use microphone positioning architectures in a device to use the smallest number of microphones to determine maximum number of sound source directions.

In some implementations, the directions of sound sources are from the front, back, left, right, top, and bottom surfaces of the device, and can be determined by amplitude and phase differences of microphone signals with proper microphone positioning. The sound source separation separates the sound coming from different directions from a mix of sources in microphone signals and identifies the direction of the sound sources. In some microphone placement implementations, sound source separation can be further performed using blind source separation (BSS), independent component analysis (ICA), and beamforming (BF) technologies. When the directions of the sound sources are separated and known, an audio-capable device can perform many kinds of audio enhancements using the microphone signals. For example, the device can perform noise reduction for communications, it can choose a source from a desired direction to perform speech recognition and it can correct the directions from which sound is perceived if the sound is perceived as coming from a direction from which it is not originating. Furthermore, microphone placement implementations described herein can generate desired sound images like stereo audio output. Additionally, with sound source separation as computed with the microphone placement implementations described herein, 2.1, 5.1, 7.1, and other known types of audio encoding and surround sound effects can be more easily computed.

Devices with architectures of two, three, and four microphones are described, as are the advantages and disadvantages of the number of microphones used. These architectures for microphone positioning maximize the determination of the number of sound source directions with a given number of microphones.

Detailed descriptions of devices with three architectures for two-microphone positioning that fully use amplitude and phase differences between the two microphones to achieve desired performance are described. These include microphone positions of: front and back, front and top, and back and top all with the distance between two microphones being measured in a straight line from left to right when the device is seen from the front.

Another device that is described in greater detail uses an architecture with three microphones. In this architecture there are a greater number of ways to position the microphones. In order to determine a greater number of sound source directions (the directions from which the sound is coming from), the microphones are placed irregularly on the surfaces of the device in order to provide an offset such that amplitude differences and time of arrival differences of sound received by the microphones can be used to determine the sound source direction(s). Although the positioning of the microphones is not limited, in some implementations it is preferred to position microphones as follows when loudspeakers are located at the left and right surfaces of a device: front-top-back, front-top-front, back-top-back, front-top-top, back-top-top. However, the architectures are not exclusive. Any of these microphone positioning architectures can be used to in order to determine six sound source directions (front, back, left, right, top, and bottom) or more. Since three microphones, are used, audio algorithms will generate better performance in terms of the number of sources determined, source separation, and mixing of desired microphone signals for a particular application.

One device described in greater detail herein has an architecture that uses four microphones. When four microphones are positioned irregularly so that there is no linear correlation of two signals from any two microphones, sources from four independent directions can be determined using just time of arrival (or practically phase) information. When both time of arrival (e.g., phase) and amplitude information are used, sources from eight independent directions can be determined when four microphones are positioned properly. Although the description describes sources from six directions: front, back, left, right, top, and bottom, the architectures can be used for determining sources from other directions. For example, one can also determine front-left, front-right, back-left, and back-right sound source directions.

Described devices and systems generate several outputs for different applications or tasks and these outputs can be optimized, or approximately optimized, for these applications and tasks. These applications and tasks can also be implemented in DSP or in the OS as an APO. Possible applications can include communications, speech recognition, and audio for video recordings. For example, in a communications application, an audio processor in an electronic device can select sound from sources from desired directions as output for telephone, VOIP, and other communications applications. The device can also mix sources from several directions as outputs. For example, several selected strong sources can be mixed as the output and other weak sources can be removed as noise.

Outputs can also be optimized, or approximately optimized, for speech recognition applications. For example, speech recognition performance is low when the input to a speech recognition engine contains the sound from several sources or background noise. Therefore, when a source from single direction (separated from a mix of microphone signals) is input into a speech recognition engine, its performance greatly increases. Source separation is a critical step for increased speech recognition performance. Hence, in some microphone placement implementations, microphone signals are optimized, or approximately optimized, for a speech recognition engine by separating the sound from sources received in the microphones from one or more directions where a person is speaking and providing only the signals from these directions to the speech recognition engine one at a time (e.g., with no mixing).

Source separation also offers a great way to perform audio encoding for video recordings. It can make 2.1, 5.1, and 7.1 encoding straightforward because sources from different directions are already determined. Hence, in some microphone placement implementations, microphone signals are optimized, or approximately optimized, for audio encoding by separating the sound from sources received in the microphones from one or more directions for encoding.

Another task where sound source location and separation is used is for sound source direction perception correction. For example, when two microphones are used where one microphone is placed in front surface of a device and the other microphone is placed in the back surface of the device, the received microphone signal contains sources with wrongly perceived sound directions in the sense that sound from the front is perceived as the sound from left, sound from back is perceived as the sound from right, sound from left is perceived as the sound from center, and sound from right direction is perceived as the sound from the center. With the proper number of microphones used and their positioning, using the microphone placement implementations described herein sound sources can be separated from different directions and can then be mixed to correct sound perception directions.

2.0 Architectures and Positioning of Microphones for a Device

Detailed descriptions of three architectures of two-microphone positioning that fully use amplitude and phase differences between two microphones to achieve desired performance are described. These include microphone positions of: front and back, front and top, and back and top all with the distance between two microphones being measured in a straight line from left to right.

2.1 Two Microphone Architecture

When two microphones are used in a device, the positioning of the microphones is critical for determining sound source directions, which include in front, in back, to the left, to the right, on top, and on the bottom relative to the device. In this two microphone case, the number of microphones is smaller than the number of directions. The determination of sound source directions therefore uses information of device itself (e.g., the number of microphones, the amplitude differences between the sound received from a sound source at the microphones, the time of arrival differences (TAD) or phase differences between the sound received from a sound source at the microphones, among other factors).

The positioning of two microphones can be done in many ways. For example, the microphones can both be embedded in the front surface of a device, both be embedded in the back surface, both be embedded in the top surface, both be embedded in either side surface, both be embedded so that one is in front and one is in back, one is in front and one in on top, one is in back and one is on top, and so forth. Detailed descriptions of three architectures of two-microphone positioning that fully use amplitude and phase differences between the two microphones according to the microphone placement implementations described herein are provided. The microphones are located in the front and back, the front and top, and the back and top all with distance between two microphones measured in a line from left to right for purposes of explanation.

2.1.1 Architecture of Front and Back Microphone Placement

FIG. 1 depicts an exemplary device 100 that has audio capability. The device 100 has a left surface 102, a top surface 104, a bottom surface 106, a front surface 108, a right surface 110 and a back surface (not shown). The device 100 can be a computing device such as computing device 1200 described in detail with respect to FIG. 12. The device 100 can further include an audio processor 112, one or more applications 114, 116, and one or more loudspeakers 118.

FIG. 1 shows an architecture of two microphones 120,122 embedded in the device 100. One microphone 120 is embedded at a back surface (not shown) of the device 100, while the other microphone 122 is in the front surface 108 of the device 100. A distance d1 124 between the two microphones 120, 122 provides an offset between the microphones. In one implementation d1 124 is greater than the thickness of the device 126. If the distance d1 124 is equal to the thickness of the device, then the two microphones are located in a straight line vertically in the device. In this case, there is no difference between signals received by two microphones when sources are received from the left and/or right. Therefore, in some microphone placement implementations only the case where the distance d1 is greater than the thickness of the device is considered. The distance d2 134 represents the distance of the microphones from left to right.

When sound from a sound source S1 128 is from a left to right direction, the back microphone 120 receives the sound coming from the source 128 first. After a certain time, the front microphone 122 receives the sound from the source S1 128 also. There is significant time of arrival difference (TAD) (or phase difference) between the two microphones 120,122 when the offset between the microphones (e.g., d1 124) is large enough. One can define this TAD as a positive value when the sound from the source is from a left to right direction, and similarly that the TAD is negative when the sound from the source is from right to left. In the configuration shown in FIG. 1, the amplitude difference is small. Thus, the TAD is used to determine source direction from left or right when the amplitude difference is smaller than a preset threshold.

When the sound from the source is from front to back direction relative to the device 100, the amplitude of the front microphone 122 signal is much stronger than the amplitude of back 120 microphone signal because the device housing 130 provides a blocking effect. Therefore, the amplitude difference (AMD) between two signals received by the two microphones 120, 122 respectively, is dominant. The TAD or phase difference depends on the thickness of the device and distance that sound travels from the front microphone to the back microphone. The distance the sound travels is larger in this case because its direction of travel is changing. Therefore, the TAD difference is also larger. This AMD can be defined as positive in dB when the sound from the source is from the front to back direction and negative in dB when the sound from the source is from the back to the front direction. Thus, both AMD and TAD are used to determine sound source direction from front or back.

When the sound from a source (e.g., S2 132) is from the top or bottom directions, both microphones 120, 122 receive the sound at almost the same time. Both TAD and AMD are small in this case. Define TAD1 as a small positive TAD threshold (e.g., in seconds) and AMD1 as a small positive AMD threshold (e.g., in dB) (both can be frequency-dependent), when absolute TAD is smaller than TAD1 and the absolute AMD is smaller than AMD1, the sound source is either from the top or the bottom. One cannot separate mixed sound sources from the top and bottom directions using the configuration of microphones shown in FIG. 1.

In summary, using the device 100 with the architecture shown in FIG. 1, the sound source direction can be determined from the front, back, left, right, and vertical directions relative to the surfaces of the device 100, respectively. One microphone 122 is placed in the front surface of the device 100, another microphone 120 in the back surface of the device, and the distance d1 124 between the two microphones should be offset such that TAD and AMD can be used to determine the sound source direction (e.g., greater than the thickness of the device 100). Any sound source separation algorithm can be used for the purpose of separating the sound sources in this configuration once the sound source directions are determined. In addition, the microphone placement shown in FIG. 1 is not exclusive. Microphones can be placed anywhere in the device where space is available as long as one microphone is placed in the front surface of the device, another microphone is placed in the back surface of the device, and the microphones are offset enough so that TAD can be used to determine sound source direction (e.g., the distance d1 between two microphones is greater than the thickness of the device). The configuration of architecture of the device 100 shown in FIG. 1 is that the front microphone is in left position of front surface and back microphone is in right position of back surface. However, in a configuration where the front microphone is in the right position of the front surface and the back microphone is in the left position of the back surface, the sound source location and separation could equally well be determined.

2.1.2 Architecture of Front and Top Placement

Figure 2:
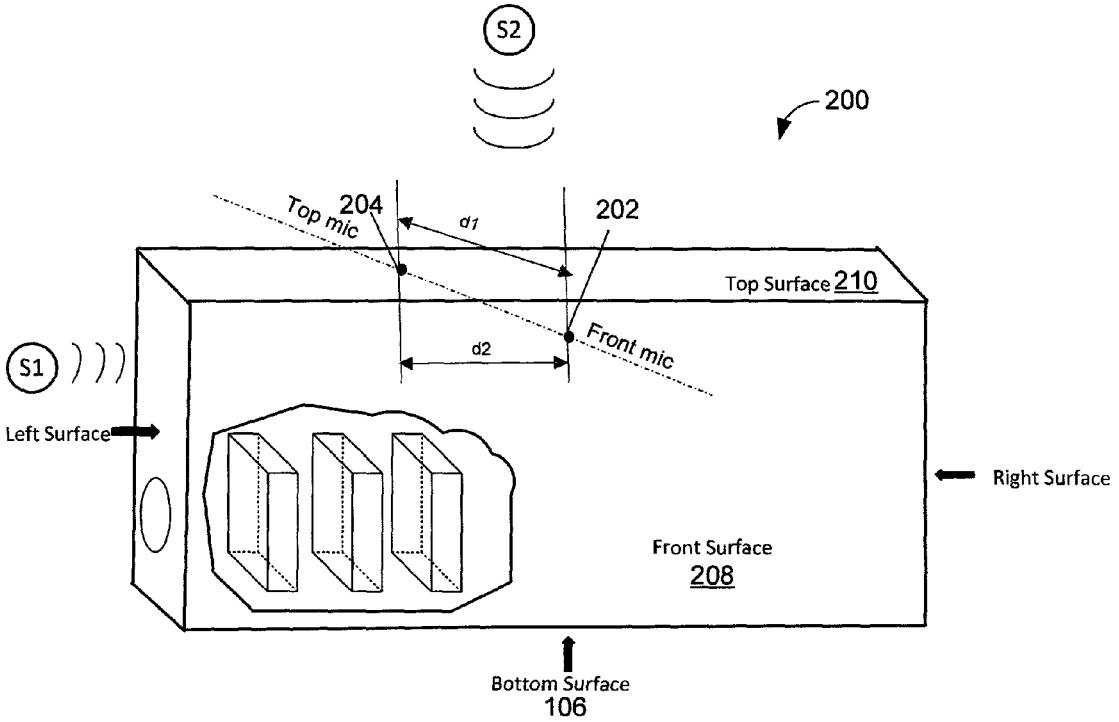
FIG. 2 is a depiction of an electronic device with microphones placed on the front and top surfaces of the device.

The architecture of another exemplary device 200 is shown in FIG. 2. This device 200 can have the same or similar surfaces, microphones, loudspeaker(s), audio processor and applications as those discussed in FIG. 1. This device has one microphone 202 located in the front surface 208 and the other microphone 204 located in the top surface 210 of the device 200. This configuration can be more advantageous in that when the device 200 is placed on a table in a way that if any microphones in the front surface or in the back surface (if any) are blocked, the top microphone 204 can still pick up audio normally.

Similar to the architecture 100 shown in FIG. 1, when sound from the source is from the left to the right direction (e.g. directed from the left to right surface), the top microphone 204 receives the sound from the source first. After certain time, the front microphone 202 receives the sound from the source. There is a significant TAD between the two microphones 202, 204 when d1 is large enough. The TAD can be defined as positive when the sound from the source is directed from the left to the right direction and negative when sound from the source is directed from the right to the left. In both cases, the amplitude difference is small because the pointing directions of both microphones are perpendicular to the sources. Thus, TAD is used to determine that the source direction is from the left or the right when amplitude difference is smaller than a preset threshold.

When the sound from the source is from the front to the back direction, the amplitude of the front microphone 202 signal is stronger than the amplitude of top microphone 204 signal because the front microphone points toward the source while the top microphone is perpendicular to the source. The TAD, however, is small because the maximum traveling distance of the sound is the thickness of the device 200. Thus, when the absolute TAD is smaller than a positive threshold and the absolute AMD is larger than another positive threshold, one can determine that the sound from the source is from the front. When the sound from the source is directed from the back to the front of the device, the top microphone signal has a greater amplitude because the top microphone 204 is pointing perpendicular to the sound source while the front microphone is pointing in the opposite direction of the source with a device blocking effect. In addition, the TAD is also larger because the direction of the sound from the source to the front microphone 202 is changed. Thus, using both AMD and TAD, it can be determined that the sound from the source is coming from the back to the front.

When sound from the sound source is directed from the top to the bottom, the top microphone 204 signal has a greater amplitude because it is pointing toward the source while the front microphone 202 is pointing in a perpendicular direction to the source. When the sound from the source is directed from the bottom to the top, the front microphone 202 signal has a stronger amplitude because the top microphone is pointing in the opposite direction from the source while the front microphone is positioned in a perpendicular direction to the source. Although pointing direction affects the amplitude of the microphone signals, the TAD is very close. Therefore, using the greater AMD and the negligible TAD, one can determine that the sound from the source is directed from top to bottom. When the sound from the source is directed from bottom to top similar TAD and AMD behavior occurs as if the sound from the source is directed from the front to the back. Therefore, this architecture may not properly separate sources from the front and bottom.

In summary, with top and front microphone configuration, one can determine whether the sound from the source is directed from the left, the right, the front and/or bottom, back, and top directions, respectively. The disadvantage is that one can only tell sources from either front or bottom or both directions. A big advantage is that one can still receive audio when front microphone is blocked by keyboard that is placed in front of the front surface of the device.

2.1.3 Architecture of Back and Top Placement

Figure 3:
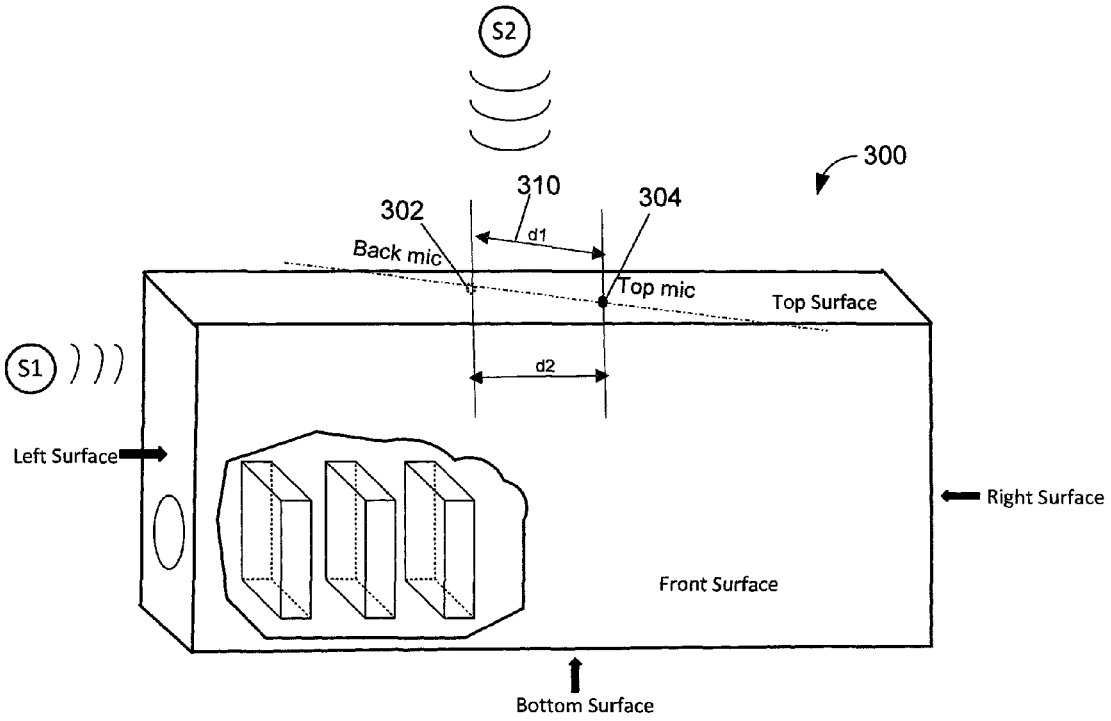
FIG. 3 is a depiction of an electronic device with microphones place on the back and top surfaces of the device.

In the architecture of the device 300 shown in FIG. 3, one microphone 304 is located in the back surface and the other microphone 302 is located in the top surface of the device. This device 300 can have the same or similar surfaces, microphones, loudspeaker(s), audio processor and applications as those discussed with respect to FIG. 1.

Similar to the architecture 100 shown in FIG. 1, when sound from the source is directed from the left to right direction, the back microphone 304 receives source first. After a certain time, the top microphone 302 receives the source. There is significant TAD between the two microphones 302, 304 when d1 310 is large enough. This TAD can be defined as positive. On the other hand, the TAD is negative when the sound from the source is from right to left. In both cases, the amplitude difference is small because the pointing directions of both microphones are perpendicular to the source. Thus, one uses TAD to determine the source direction from left or right when the amplitude difference is smaller than a preset threshold.

When sound from the source is directed from the back to the front direction, the amplitude of back microphone 302 signal is stronger than the amplitude of top microphone 304 signal because the back microphone is pointing toward the source while the top microphone is perpendicular to the source. The TAD, however, is small because maximum traveling distance is the thickness of the device. Thus, when there is a smaller absolute TAD compared with a positive threshold and larger absolute AMD compared with another threshold, it can be determined that the sound from the source is from the back direction. When source is from the front to the back of the device, the top microphone signal has a stronger amplitude because the top microphone is pointed perpendicular to the source while the back microphone pointing in an opposite direction to the source with the housing of the device providing a blocking effect. In addition, the TAD is also larger because the direction the sound travels from the source to the back microphone is changed. Thus, when the absolute AMD is larger than a positive threshold and the absolute TAD is larger than another threshold, it can be determined that the sound from the source is directed from the front to the back.

When sound from the source is from top to bottom, the top microphone 304 signal has a stronger amplitude because it is pointing towards the source while the back microphone 302 is pointed in perpendicular direction to the source. When the sound from the source is directed from the bottom to the top, the back microphone 302 signal has a larger amplitude because the top microphone 304 is pointed in an opposite direction to the source while the back microphone 302 is pointed in a perpendicular direction to the source. Although the direction a microphone is pointed affects the amplitude of the microphone signals, the TAD between the microphones is very close. Therefore, using an AMD with a preset threshold and almost no TAD, it can be determined that the sound from the source is directed from the top to the bottom. The source from bottom to top direction has similar TAD and AMD behaviors to the source from front to back direction. Therefore, this architecture may not properly separate sources when the sound is from the back and the bottom.

In summary, with a top 304 and back 302 microphone configuration, it can be determined whether the sound from the source is from the left, right, front and/or bottom, back, and top directions, respectively, using TADs and AMDs.

2.2 Cases of Three or More Microphones

In a device, there are many surfaces. For example, a cell phone, a monitor, or a tablet has at least six surfaces. Adjacent surfaces are usually approximately perpendicular. When microphones are placed in different surfaces, the difference of amplitude and/or phase in the signals received by the different microphones will be larger. The amplitude and/or phase differences therefore can be used to robustly estimate the maximum number of sound source directions (the directions where the sound is coming from) with smallest number of microphones. In the examples with two microphones described above, up to five sound source directions can be estimated.

Figure 4:
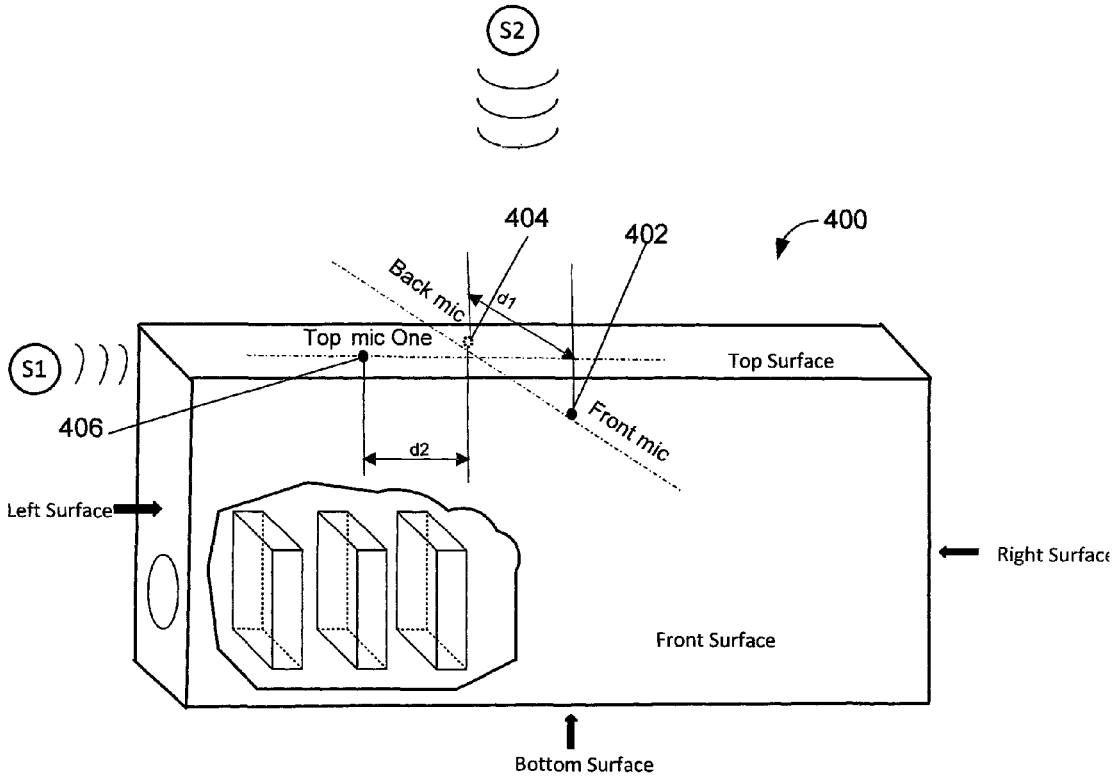
FIG. 4 is a depiction of an electronic device with a placement of three microphones on the top, back, and front surfaces of the device.

FIG. 4 shows an architecture of a device 400 where three microphones are used in which one 402 is in the front surface, the second 406 is in the top surface, and the third one 404 is in the back surface. This device 400 can have the same or similar surfaces, microphones, loudspeaker(s), audio processor and applications as those discussed with respect to the device 100 in FIG. 1.

Compared with the architecture of the device 100 shown in FIG. 1, one can see that an additional microphone 406 on the top surface is used. For the architecture of the device 100 shown in FIG. 1, one can estimate five sound source directions where it is impossible to distinguish sounds from top or from bottom directions. With the additional microphone on the top surface as shown in FIG. 4, it is possible to now distinguish sounds from top or from bottom directions in addition to other directions because if the sound is coming from the top, the top microphone signal is stronger in amplitude than both the front and back microphones, and if the sound is coming from the bottom, the signal received by the top microphone is weaker in amplitude than both front and back microphones. In both cases, the TAD/phase difference is very small.

There are more ways to position the microphones in the device when three microphones are used. In order to determine a greater number of sound source directions, it is preferable to place the microphones irregularly on a surface relative to each other. Although the positioning of the microphones is not limited in some microphone placement implementations described herein, the positioning of the three microphones is as follows: front-top-back, front-top-front, back-top-back, front-top-top, back-top-top (especially when loudspeakers are located at left and right side surfaces of a device). The order from left to right can also be switched. Because three microphones are used, signal processing algorithms will generate better performance in terms of number of source determination, source separation, and mixing of desired signals.

Figure 5:
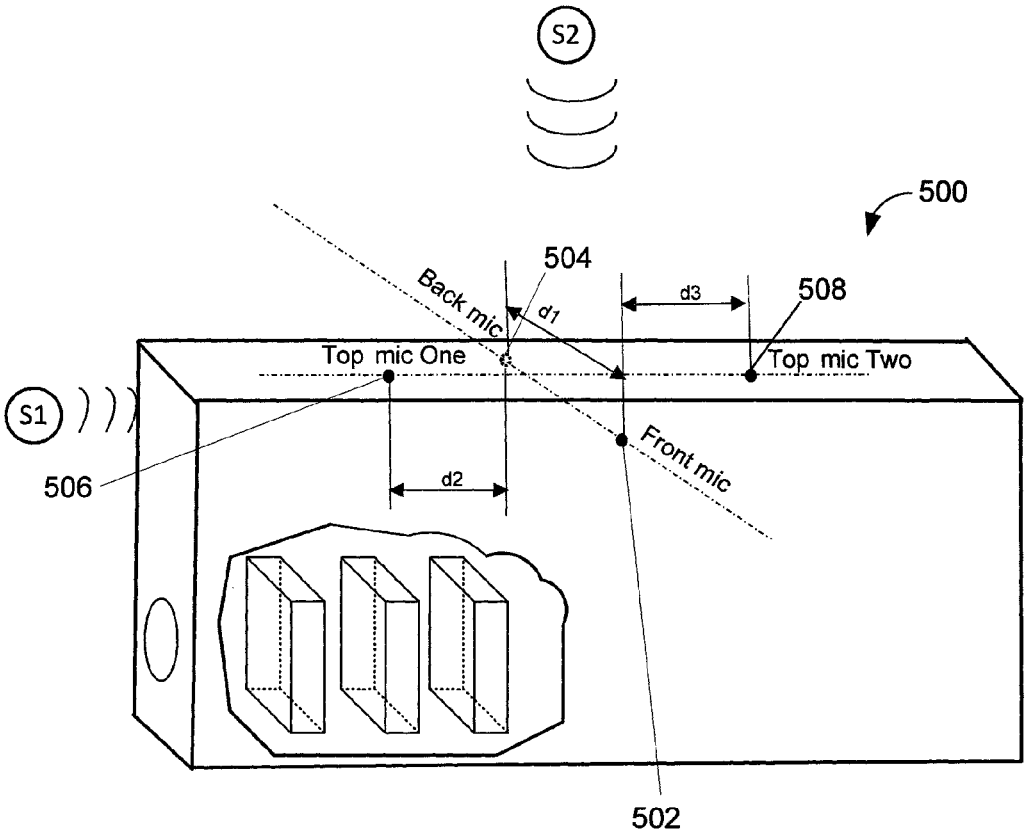
FIG. 5 is a depiction of an electronic device with a placement of four microphones on the back, top, top and front surfaces of the device.

FIG. 5 shows an architecture of a device 500 in which four microphones are used. This device 500 can have the same or similar surfaces, microphones, loudspeaker(s), audio processor and applications as those discussed in FIG. 1. One microphone 502 is in the front surface, the second microphone 504 is in the back surface, and third microphone 506 and fourth microphone 508 are in the top surface. Compared to the device 100 shown in FIG. 1, one can see that there are two microphones 506, 508 on the top surface. It is clear that this architecture of device 500 can estimate at least 6 sound source directions.

When four microphones are positioned irregularly so that both TAD/phase and amplitude information are usable for determining sound source directions, sources from many independent directions can be determined. Although many microphone placement implementations described herein attempt to locate the sound sources from six directions: front, back, left, right, top, and bottom, the architecture of the device 500 shown in FIG. 5 can be used for determine sources from other directions. For example, one can also determine front-left, front-right, back-left, and back-right sound source directions.

There are more ways position four microphones in a device. The architecture of the device 500 shown in FIG. 5 is just one of example of microphone positioning using four microphones. In order to determine a greater number of sound source directions, one implementation places the four microphones irregularly in the sense that there are less cases where the amplitude and/or the phase of sound received by the microphones are the same or similar. Because four microphones are used, audio algorithms will generate much better performance in terms of number of source determination, source separation, and mixing of desired signals. The cost of both hardware and signal processing, however, is higher.

2.3 User Scenarios

User scenarios define how a user and audio device interact. For example, a user can use two hands to hold the device, the user can place the device on a table, and the user may place the device on a table in addition to covering the top surface of the device with, for example, a keyboard. With proper placement of microphones on a device, one can maximize the user experience in the sense that the user's voice can still be picked up by at least one microphone in most of user scenarios.

2.4 System and Architecture of Processors

Devices and systems according to the microphone placement implementations described herein will separate and/or partition the sound from sources from different directions based on number of microphones used and their positioning. They will mix sound from the separated sources into outputs that are useful for, or are optimized or approximately optimized for, different applications.

Figure 6:
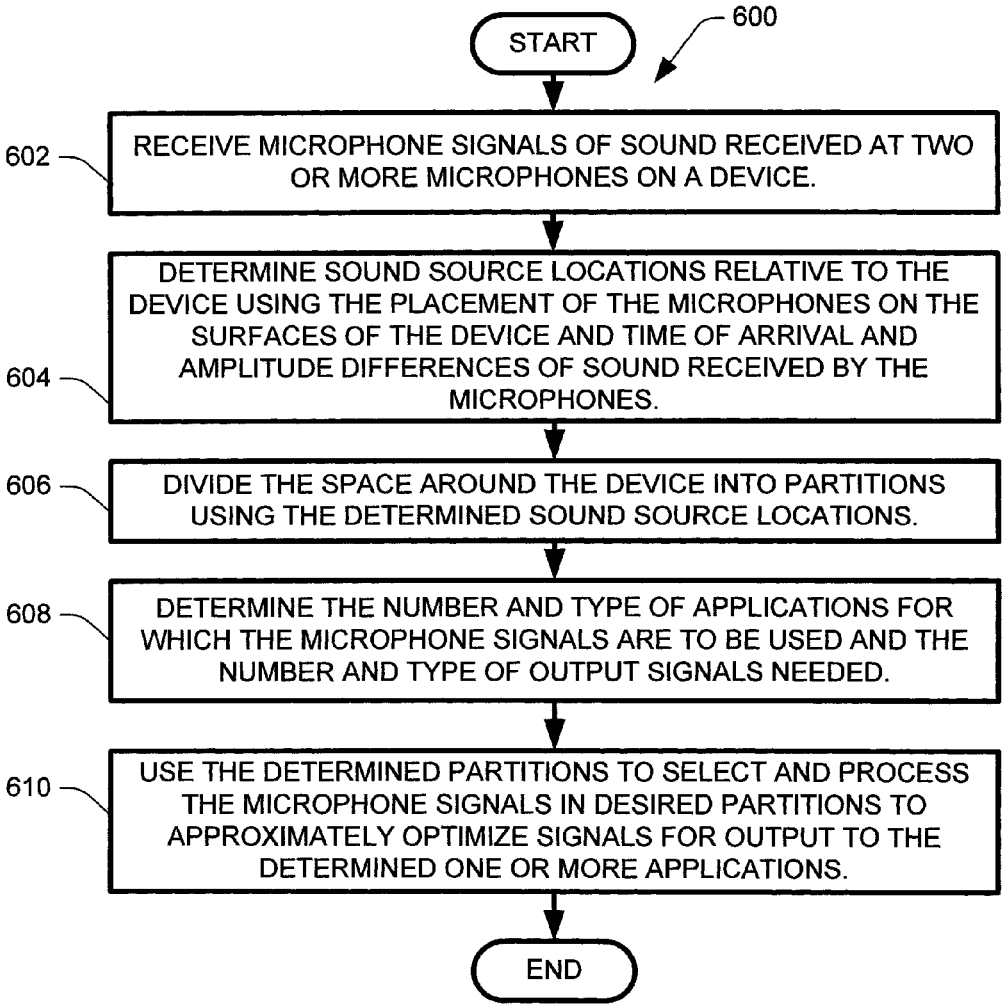
FIG. 6 is an exemplary flow diagram of a process for using located sound sources to prepare output which are input into an application.

FIG. 6 shows a block diagram of an exemplary process 600 for determining the sound source directions using various microphone placement implementations described herein and processing the sound received for use with one or more applications. As shown in FIG. 6, block 602, microphone signals of sound received from two or more microphones on a device are received. The sound source locations relative to the device are determined using the placement of the two or more microphones on the surface of the device and time of arrival and amplitude differences of sound received by the microphones, as shown in block 604. The space around the device is partitioned using the determined sound source locations, as shown in block 606. This can be done, for example, by using a binary solution process 800, a time-invariant partition process 900 or an adaptive separation process 1000, which will be described in greater detail with respect to FIGS. 8, 9 and 10. The number and type of applications for which microphone signals are to be used and the number and type of output signals needed are determined, as shown in block 608. The determined partitions are then used to select the microphone signals from desired partitions to approximately optimize signals for output to the determined one or more applications, as shown in block 610.

Figure 7:
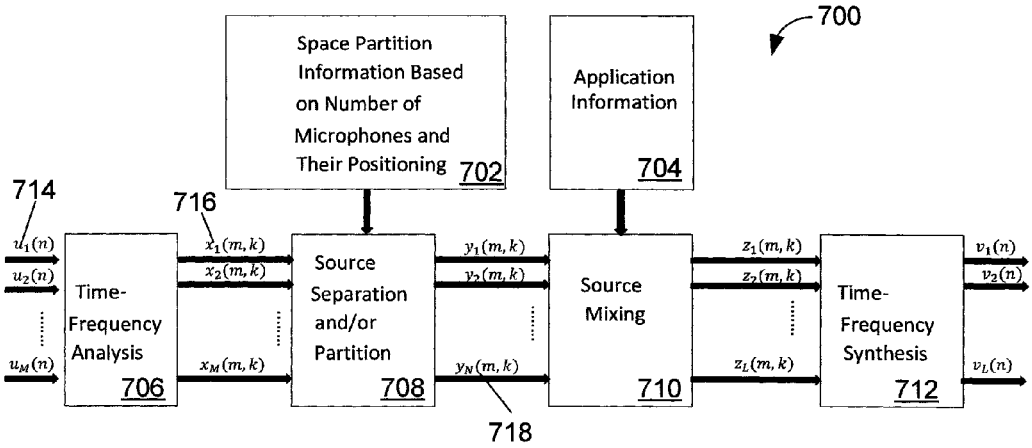
FIG. 7 is a depiction of an exemplary architecture for processing audio signals in accordance with the microphone placement implementations described herein.

FIG. 7 shows a block diagram of a general system or architecture 700 for processing microphone signals (e.g., at an audio processor such as, for example, the audio processor 112 of FIG. 1) for various applications. This system or architecture can be used to optimize, or approximately optimize, the outputs for various applications.

There are six blocks in the architecture 700 shown in FIG. 7: a space partition information block 702, an application information block 704, a joint time-frequency analysis block 706, a source separation block 708, a source mixing block 710, and a time frequency synthesis block 712. These blocks will be discussed in greater detail in the paragraphs below.

2.4.1 Space Partition Information Block

The space partition information block 702 uses the determined sound source locations to partition the space around an electronic device via different methods. One of the methods can be based on analysis of the architectures of the device shown in FIG. 1 to FIG. 5 which are used to figure out how many independent sound source directions there are. The space around the device can be partitioned according to the independent sound sources. For example, in the case of two microphones, five sound source directions can be determined. Therefore, the space around the device can be partitioned into five subspaces. For more microphones, the desired number of subspaces and their structure can be specified, in addition to the determined independent sound source directions.

2.4.2 Time Frequency Analysis Block

The microphone inputs 714 are converted from the time domain into a joint time-frequency domain representation. As shown in FIG. 7, microphone inputs 714 $u_i(n)$, $1 \le i \le M$ from M microphones are analyzed with the joint time-frequency analysis block 706, where n is a time index. For example, a sub-band, short-time Fourier transform, Gabor expansion, and so forth can be used to perform joint time-frequency analysis as is known in the art. The outputs 716 of the joint-time frequency analysis block 706 are $x_i(m, k)$, $0 \le i < M$, in which m is a frequency index and k is a block index.

2.4.3 Source Separation Block

One area of processing in the audio processor is sound source separation and/or partition of the space around an electronic device based on inputs from the joint time frequency analysis block 706 and the space partition information block 702. This sound source separation and/or partitioning are performed in the source separation block 708. In one implementation, the space around a device is divided into N disjointed subspaces. Based on the number of microphones used and their positioning, the source separation block 708 generates N signals $y_n(m, k)$, $0 \le n < N$ that are from the subspace directions, respectively. One can use a mathematical equation to represent the output 718 from the source separation block as $$y_n(m,k)=\Sigma_{i=0}^{M-1}h_i(n,m,k)x_i(m,k) \quad (1)$$

One can see that outputs 718 are a linear combination of inputs 716. The coefficients $h_i$ (n, m, k) of the outputs 718 need to be determined. There are many ways to determine the coefficients of the outputs 718 based on advanced signal processing technologies and the number of microphones and their positioning. The following paragraphs detail three solutions that can be used to find the coefficients of the outputs 718: a binary solution where $h_i$ (n, m, k) is either zero or one, a time-invariant solution where $h_i(n, m, k)=h_i(n, m)$ for all k and is obtained by an offline optimization or slow online optimization process, and an adaptive time-varying solution where the coefficients of the outputs are obtained in real-time adaptively based on the inputs and the space partition.

Figure 8:
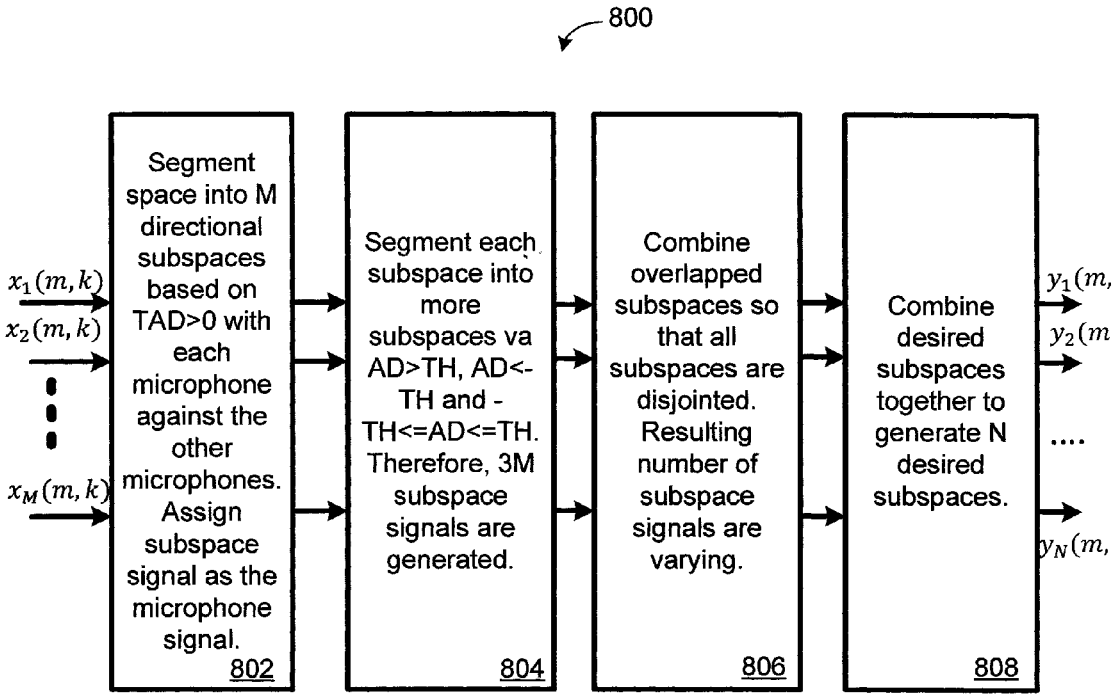
FIG. 8 is an exemplary depiction of a binary partition solution to determine filter coefficients for the system shown in FIG. 7.

FIG. 8 shows a diagram of a binary solution process 800 for partitioning the space around the device to determining the output coefficients 718 (e.g., using the source separation block 708). First, as shown in block 802, from the direction of each microphone, a subspace is obtained such that the time of arrival difference TAD for a signal from the subspace to other microphones is greater than 0. Let M be an integer, then M subspaces corresponding to M microphones can be generated in which the subspace signal is assigned to the microphone signal in or closest to that subspace. This implies that the coefficient for the subspace microphone signal is assigned to be one and other coefficients are zeros (e.g., it is a binary operation). Second, as shown in block 804, each subspace is further divided into three subspaces based on amplitude differences AD. That is, AD>TH, AD<−TH, and TH−<=AD<=TH, where TH is a threshold. In this way, 3M subspaces are obtained with each assigned a microphone signal or zero. Third, as shown in block 806, the common subspaces are combined so that there is no subspace overlap. The common subspaces are defined as where they are obtained with the same information and are called overlapped subspaces if they are used separately. For example, in the case shown in FIG. 1, where one microphone is in the front surface and the other is in the back surface, the subspace above the device and the subspace below the device are overlapped and must be combined into one subspace because they cannot be separated as addressed in Section 2.1.1. And finally, as shown in block 808, the subspaces are combined into N desired subspaces, and, as shown in block 810, the combined signals for the desired subspace are output.

Figure 9:
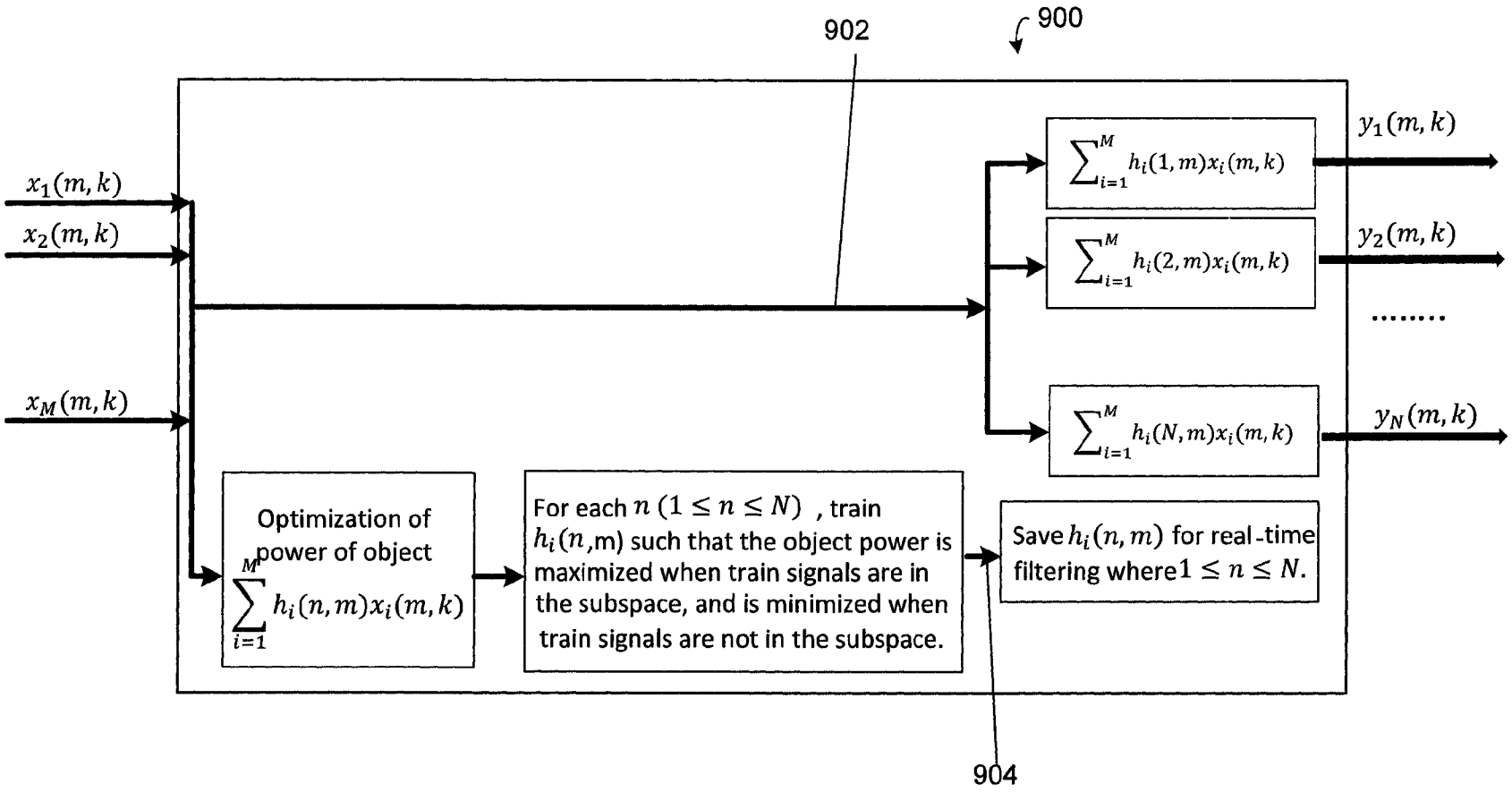
FIG. 9 is an exemplary depiction of a time invariant solution to determine filter coefficients for the system shown in FIG. 7.

FIG. 9 shows a flow diagram of a process 900 for a time-invariant partition solution for determining the output 718 coefficients. The top path 902 is for real-time operation and the bottom path 904 depicts the offline training process that is used to determine the coefficients for the outputs 718. A set of N filters are trained offline or slowly online so that $h_i(n, m, k)=h_i(n, m)$ for all k. This involves playing a signal in segment n, $1 \le n \le N$, recording signals in the microphones, and computing a ratio of a microphone signal in or closest to the segment to other microphones (it is phase and amplitude difference between signals). Let the ratio be $a_i(n, m)$, $1 \le n \le N$. Then playing signals around the device in which the signals are preferred to be white noise, and recording signals in all microphones, choose $h_i(n, m)$ to minimize $$J=\Sigma_k|y_n(m,k)|^2 \tag{2}$$

Under condition $$\Sigma_{i=1}^{N}a_i(n,m)h_i(n,m)=1 \tag{3}$$

This will guarantee that a signal from the segment's direction has no distortion in the signal of that segment's microphone. Note that since it is offline training, the summation in Eq. (2) is for all recorded samples. This will ensure that the trained filter coefficients are robust.

Figure 10:
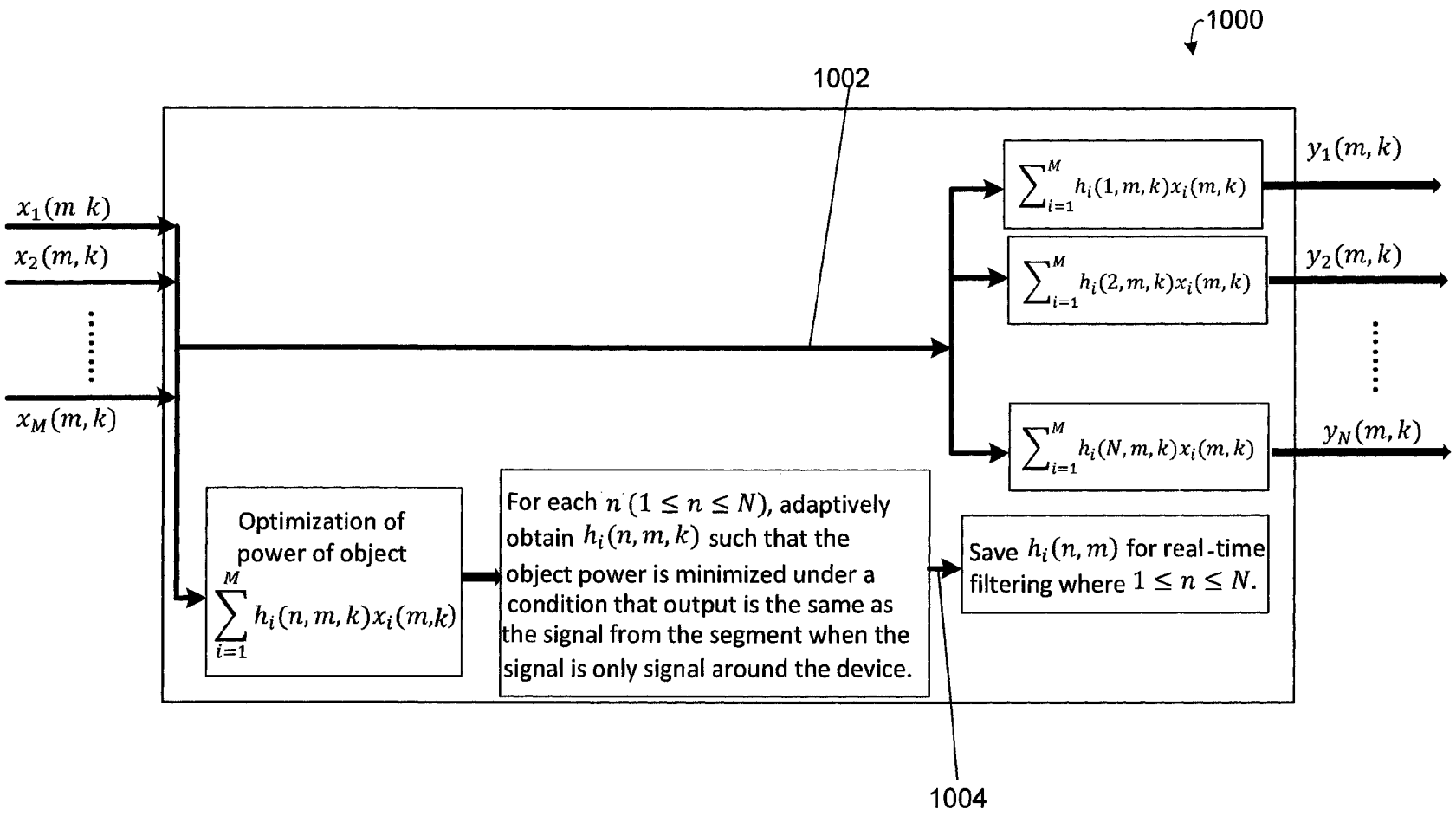
FIG. 10 is an exemplary depiction of an adaptive source separation process for the system shown in FIG. 7.

FIG. 10 shows the diagram of a process 1000 for an adaptive source separation solution. The top path 1002 is for real-time operation for determining the coefficients and the bottom path 1004 is for performing an online adaptive operation for coefficients. The first step is the same as in the time-invariant solution such that a signal is played offline in segment n, $1 \le n \le N$, the signals are recorded in the microphones, and the ratio of the microphone signal in or closest to the segment to other microphones is computed (it is phase and amplitude difference between signals). Let the ratio be $a_i(n, m)$, $1 \le n \le N$. Now filter coefficients are obtained via $$J=\Sigma_{k-P+1}^{k}|y_n(m,k)|^2 \tag{4}$$

Under condition $$\Sigma_{i=1}^{N}a_i(n,m)h_i(n,m,k)=1 \tag{5}$$

where J is the energy of sound and the object to be optimized. Optimization implies that sound from a partition is maintained and sound from other places is minimized. One can see from Eq. (4) that object J is a summation of powers over the past number of blocks and the current block with a number of blocks as P. The coefficients are data dependent and can be different from block to block if the direction the signal comes from varies from a block to other blocks.

2.4.4 Application Information Block

Signals sent to a network or another block for further processing depend on the applications involved. Such applications can be speech recognition, VOIP, audio for video recording, x.1 encoding, and others. In some microphone placement implementations described herein the device can determine the particular application the received microphone signals are being used for, or can be provided the particular application the received microphone signals are being used for, and this information can be used to optimize, or approximately optimize, the outputs for the intended application. The application information block 704 determines the number of outputs that are required to support these applications. Let the number of applications be Q, then there are Q outputs needed simultaneously. In each application, there are number of outputs. Define the number of outputs for an application as L. The number of outputs is determined by the number and types of applications. For example, stereo audio for video recording needs two outputs, left and right outputs. A speech recognition application can use just one output, and a VOIP application may need only one output also.

2.4.5 Source Mix Block

Based on an application, several outputs for the applications can be generated based on the number of microphones and microphone positioning in a device in the source mix block 710. These tasks can be implemented in DSP or as an Audio Processing Object (APO) running with an operating system (OS). The outputs can also be optimized, or approximately optimized, for these applications.

In a communications application, the device can select sources from desired directions as output for telephone, VOIP, and other communications applications. The device can also mix sources from several directions in the source mix block 710. Furthermore, the device can mix voices and useful audio only so that output will not contain noise (unwanted components) in the source mix block 710.

In a speech recognition application, the performance of the application is low when the input to the speech recognition engine contains several sources or background noise. Therefore, when a source received from a single direction (separated from a mix of signals) is input to speech recognition engine, its performance increases greatly. The source separation is an important step for increasing speech recognition performance. If one wants to recognize voices around the device, one can choose only one strongest signal for input to the speech recognition engine (e.g., the mixing action is a binary action for a speech recognition application.)

Source separation offers great way for audio encoding for video recordings. It can make 2.1, 5.1, and 7.1 encoding straightforward because the location of the sources from different directions are already determined. Further mixing can be needed if the outputs are less than separated sources. In this case, space partitioning is useful for the mixing.

Another application is source perception direction correction. For example, when two microphones are used where one microphone is placed in front surface of a device and the other microphone is placed in the back surface of the device so that there is a distance between two microphones in a straight line from left to right of the device, the microphone signal contains the sounds from sources that are perceived as coming from the wrong direction in the sense that sound from front direction is perceived as the sound from left direction, the sound from the back is perceived as the sound coming from the right, the sound from the left is perceived as the sound from the center, and the sound from right direction Is perceived as the sound from the center direction too.

One of audio enhancements is to enhance stereo effect. When two microphones are positioned in a small device, the distance between the two microphones is very short (in the range of a few tens of millimeters). Therefore, the stereo effect is limited. With the microphone placement implementations proposed herein, the sources are separated already. When separated signals are mixed for stereo output, one can increase the virtual distance in the mix to increase stereo effect.

Figure 11:
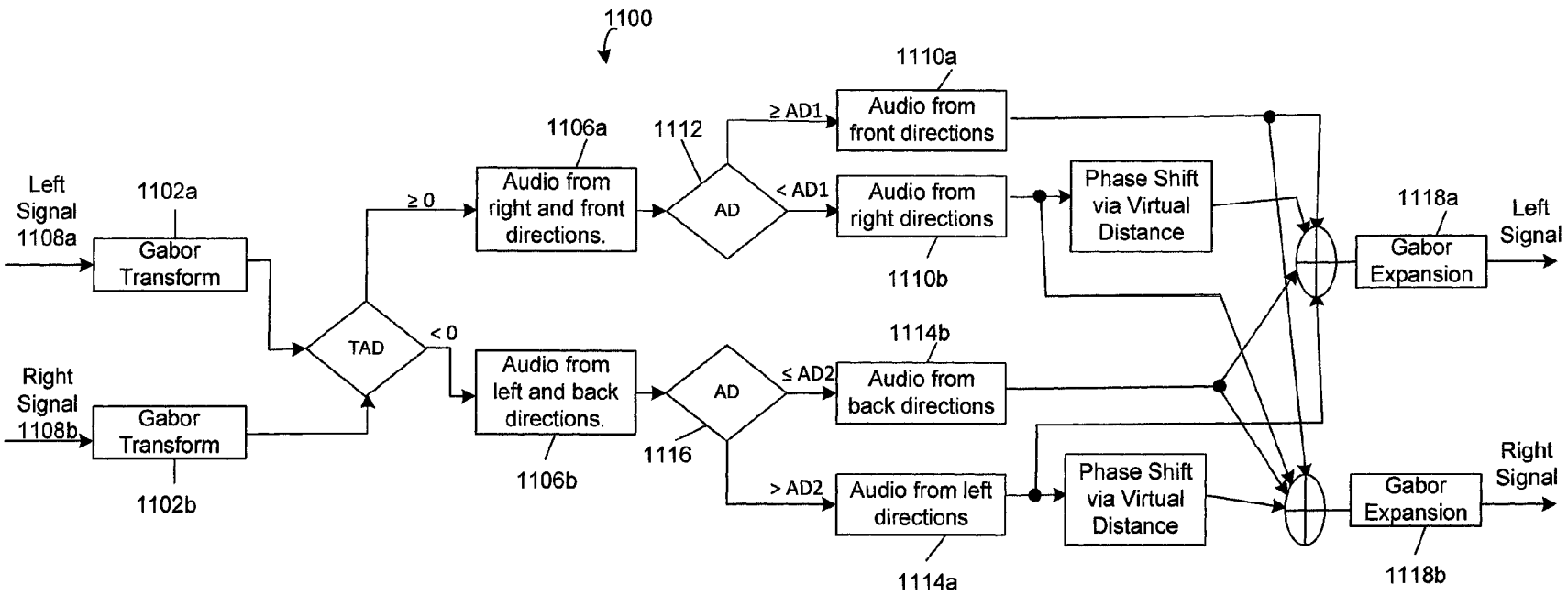
FIG. 11 depicts an exemplary stereo output effect enhancement for the device shown in FIG. 1.

FIG. 11 shows a complete solution for stereo effect enhancement for the architecture in the device 100 shown in FIG. 1. Gabor expansion 1102*a*, 1102*b* is used to perform joint time-frequency analysis. Time of arrival difference (TAD) is used to determine two mixed sources for the input signals 1108*a*, 1108*b*; the one mixed source 1106*a* is from the right and front, and the other mixed source 1106*b* is from the left and back. Then the mixed source 1106*a* from right and front is separated into a right source 1110*b* and a front source 1110*a* via amplitude difference (AD) 1112. Similarly, the mixed source 1106*b* from the left and back can be separated into left source 1114*a* and back source 1114*b* also via amplitude difference 1116. Finally, the front 1110*a* and back 1114*b* sources are kept the same in both channels of a stereo output as center audio, the left source 1114*a* is added to the left channel without change and added to the right channel with a larger phase computed via a virtual distance. The right source is added to the right channel without change and added to the left channel with a larger phase computed via a virtual distance. Note that stereo effect can also be realized via amplitude difference. Thus, in some implementations, some attenuation is inserted in addition to added phase. In this way correct audio will be perceived with an enhanced effect. Gabor expansion 1118*a*, 1118*b* is also used to synthesize joint time-frequency representation into a time domain stereo signal.

It should be noted that the audio processing for some of the microphone placement implementations described herein can be dependent on the orientation of the device and also dependent on which type of application a user is running. A device with an inertial measurement unit (e.g., with a gyroscope and an accelerometer) will know which orientation it is in. If a user is holding the device upright, then the audio processor can use that information to make determinations about where the sources are and what the user is doing (e.g., walking around). For example, if the device includes a kickstand, and the kickstand is deployed and the device is stationary, then the audio processor can infer that the user is sitting at a desk. The audio processor can also know what the user is doing, (e.g, the user is engaged in a video conference call). This information can used in the audio processor's determination about where the sound is coming from, the nature of the source of the sound, and so forth.

3.0 Other Implementations

What has been described above includes example implementations. It is, of course, not possible to describe every conceivable combination of components or methodologies for purposes of describing the claimed subject matter, but one of ordinary skill in the art may recognize that many further combinations and permutations are possible. Accordingly, the claimed subject matter is intended to embrace all such alterations, modifications, and variations that fall within the spirit and scope of detailed description of the microphone placement implementation described above.

In regard to the various functions performed by the above described components, devices, circuits, systems and the like, the terms (including a reference to a "means") used to describe such components are intended to correspond, unless otherwise indicated, to any component which performs the specified function of the described component (e.g., a functional equivalent), even though not structurally equivalent to the disclosed structure, which performs the function in the herein illustrated exemplary aspects of the claimed subject matter. In this regard, it will also be recognized that the foregoing implementations include a system as well as a computer-readable storage media having computer-executable instructions for performing the acts and/or events of the various methods of the claimed subject matter.

There are multiple ways of realizing the foregoing implementations (such as an appropriate application programming interface (API), tool kit, driver code, operating system, control, standalone or downloadable software object, or the like), which enable applications and services to use the implementations described herein. The claimed subject matter contemplates this use from the standpoint of an API (or other software object), as well as from the standpoint of a software or hardware object that operates according to the implementations set forth herein. Thus, various implementations described herein may have aspects that are wholly in hardware, or partly in hardware and partly in software, or wholly in software.

The aforementioned systems have been described with respect to interaction between several components. It will be appreciated that such systems and components can include those components or specified sub-components, some of the specified components or sub-components, and/or additional components, and according to various permutations and combinations of the foregoing. Sub-components can also be implemented as components communicatively coupled to other components rather than included within parent components (e.g., hierarchical components).

Additionally, it is noted that one or more components may be combined into a single component providing aggregate functionality or divided into several separate sub-components, and any one or more middle layers, such as a management layer, may be provided to communicatively couple to such sub-components in order to provide integrated functionality. Any components described herein may also interact with one or more other components not specifically described herein but generally known by those of skill in the art.

The following paragraphs summarize various examples of implementations which may be claimed in the present document. However, it should be understood that the implementations summarized below are not intended to limit the subject matter which may be claimed in view of the foregoing descriptions. Further, any or all of the implementations summarized below may be claimed in any desired combination with some or all of the implementations described throughout the foregoing description and any implementations illustrated in one or more of the figures, and any other implementations described below. In addition, it should be noted that the following implementations are intended to be understood in view of the foregoing description and figures described throughout this document.

Various microphone placement implementations are by means, systems and processes for determining sound source locations using device geometries and amplitude and time of arrival differences in order to optimize or approximately optimize audio signal processing for various specific applications.

As a first example, various microphone placement implementations are implemented in a process that: receives microphone signals of sound received from two or more microphones on a device; determines sound source locations relative to the device using the placement of two or more microphones on surfaces of the device and time of arrival and amplitude differences of sound received by the microphones; divides the space around the device into partitions using the determined sound source locations; determines the number and type of applications for which the microphone signals are to be used and the number and type of output signals needed; and uses the determined partitions to select and process the microphone signals from desired partitions to approximately optimize signals for output to the determined one or more applications.

As a second example, in various implementations, the first example is further modified by means, processes or techniques such that dividing the space around the device into partitions further comprises: from the direction of each microphone obtaining a subspace such that the time of arrival differences for sound from the subspace to the other microphones is greater than 0; dividing each subspace into three additional subspaces based on the amplitude differences between the microphones; combining common subspaces so that there are no overlapping subspaces; combining the subspaces into a number of desired subspaces that contain desired subspace signals; and outputting the desired subspace signals for the combined subspaces for use with the one or more applications.

As a third example, in various implementations, any of the first example or the second example are further modified via means, processes or techniques such that dividing the space around the device into partitions further comprises: determining if an amplitude difference between the microphones is greater than a positive threshold, less than a negative threshold or between the positive threshold and the second negative threshold.

As a fourth example, in various implementations, any of the first example, second example or third example are further modified such that a source signal in one or more partitions is determined via a binary, a time-invariant or and adaptive solution.

As a fifth example, in various implementations, any of the first example, the second example, the third example or the fourth example are further modified such that a subspace signal in on or more partitions are determined, and wherein coefficients of the subspace signal are obtained by using a probabilistic classifier that minimizes distortion of the subspace signal.

As a sixth example, in various implementations, any of the first example, second example, third example, fourth example or fifth example are further modified via means, processes, or techniques such that the number of applications is determined by determining the number of applications that run simultaneously and multiplying the determined number of applications by the outputs required for each application.

As a seventh example, in various implementations, any of the first example, second example, third example, fourth example, fifth or sixth example are further modified via means, processes, or techniques such that the signals output to the determined one or more applications are approximately optimized to perform noise reduction in a communications application.

As an eighth example, in various implementations, any of the first example, second example, third example, fourth example, fifth example or sixth example are further modified via means, processes, or techniques such that the signals output to the determined one or more applications are approximately optimized to perform noise reduction in a speech recognition application.

As an ninth example, in various implementations, any of the first example, second example, third example, fourth example, fifth example or sixth example are further modified via means, processes, or techniques such that the signals output to the determined one or more applications are approximately optimized to correct incorrectly perceived sound source directions.

As a tenth example various microphone placement implementations comprise a device with a front-facing surface, a back-facing surface, a left-facing surface, a right-facing surface, a top-facing surface and bottom facing surface; one microphone on one surface and another microphone on an opposing surface, wherein there is a distance between the two microphones measured from left to right when viewed from the surface having one of the microphones, the microphones generating audio signals in response to one or more external sound sources; and an audio processor configured to receive the audio signals from the microphones and determine the directions of the one or more external sound sources using their positioning on the surfaces of the device and time of arrival differences and amplitude differences between signals received by the microphones.

As an eleventh example, in various implementations, the tenth example is further modified via means, processes or techniques such that the distance between the microphones is greater than a thickness of the device measured as the smallest distance between the two opposing surfaces.

As a twelfth example, any of the tenth example and the eleventh example are further modified via means, processes or techniques such that the sound source directions are determined by determining whether a time of arrival difference for a signal from one microphone to the other microphone is greater than a positive threshold, less than a negative threshold, or between the positive threshold and the negative threshold.

As a thirteenth example, any of the tenth example, eleventh example, and twelfth example are further modified via means, processes or techniques such that the sound source directions are determined by determining if an amplitude difference between the microphones is greater than a positive threshold, less than a negative threshold or between the positive threshold and the second negative threshold.

As a fourteenth example, any of the tenth example, eleventh example, twelfth example and thirteenth example are further modified via means, processes or techniques such that there are additional microphones in the surfaces that increase a maximum number of directions relative to the surfaces that can be determined.

As a fifteenth example various microphone placement implementations comprise a device with a front-facing surface, a back-facing surface, a left-facing surface, a right-facing surface, a top-facing surface and a bottom facing surface; one microphone on one surface and another microphone on an adjacent surface, wherein one of the microphones is offset such that it is closer to a surface of the device that is orthogonal to both of the surfaces containing the microphones, the microphones generating audio signals in response to one or more external sound sources; and an audio processor configured to receive the audio signals from the microphones and determines the direction of the one or more external sound sources in terms of the surfaces of the device.

As a sixteenth example, in various implementations, the fifteenth example is further modified via means, processes or techniques such that the direction of the sound relative to the surface is determined by using amplitude differences between signals generated by the microphones, and by using the time of arrival differences from the sound of an external sound source to the respective microphones.

As a seventeenth example, in various implementations, any of the the fifteenth example or the sixteenth example are further modified via means, processes or techniques such that if the amplitude is substantially the same in both microphones, and the time of arrival is sooner in a first one the microphones, then it is determined that the sound source is directed towards an adjacent surface that is orthogonal to both of the surfaces containing the microphones, wherein the adjacent surface is also closer to the first microphone.

As an eighteenth example, in various implementations, any of the fifteenth example, the sixteenth example or the seventeenth example are further modified via means, processes or techniques such that if the amplitude is greater in a first one of the microphones, the time of arrival difference between the microphones is smaller than a threshold, and the time of arrival is sooner for the first microphone, it is determined that the sound source is directed towards a surface containing the first microphone.

As nineteenth example, in various implementations, the sixteenth example is further modified via means, processes or techniques such that if the amplitude is greater in a first one of the microphones, the time of arrival difference between the microphones is greater than a threshold, and the time of arrival is sooner for the first microphone, then the sound source is determined to be directed towards a surface opposite to the surface containing the other microphone.

As a twentieth example, in various implementations, any of the fifteenth example, the sixteenth example, the seventeenth example, the eighteenth example and the nineteenth example are further modified via means, processes or techniques such that the distance between the microphones is greater than a thickness of the device measured as the smallest distance between two opposing surfaces.

Figure 12:
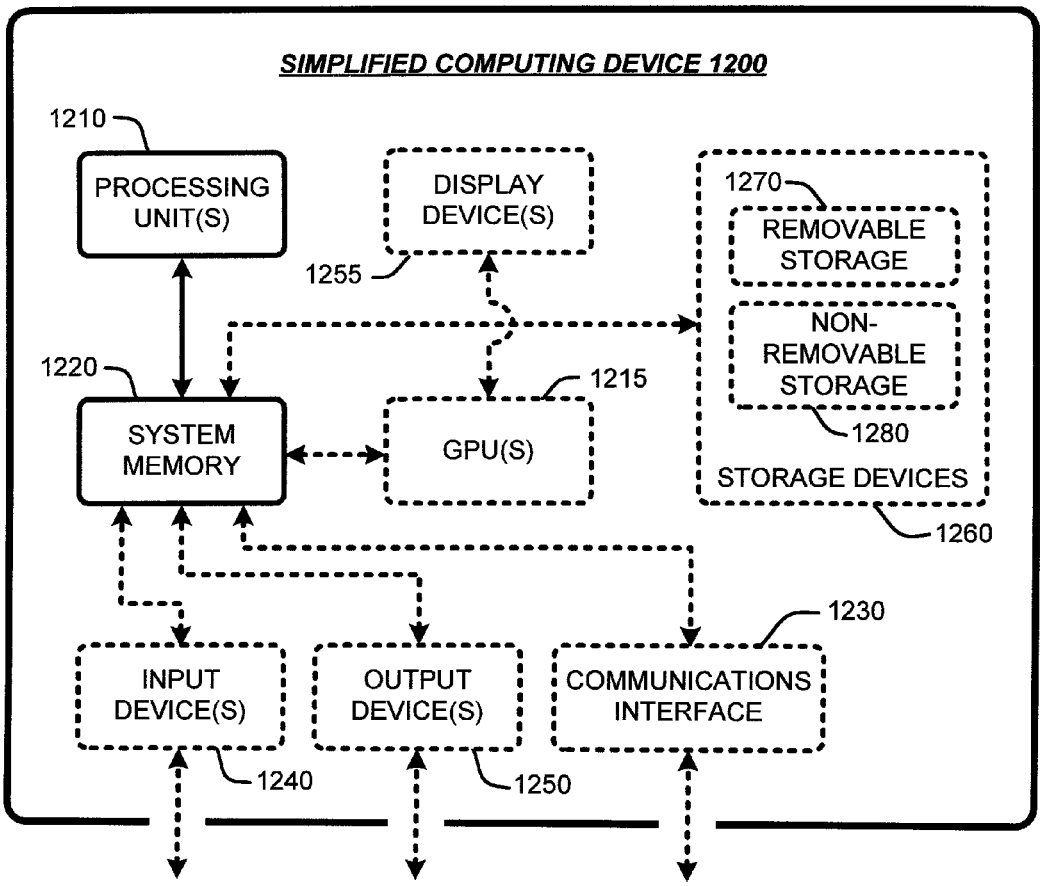
FIG. 12 is an exemplary computing system that can be used to practice the exemplary microphone placement implementations described herein.

3.0 Exemplary Operating Environment:

The microphone placement implementations described herein are operational within numerous types of general purpose or special purpose computing system environments or configurations. FIG. 12 illustrates a simplified example of a general-purpose computer system on which various elements of the microphone placement implementations, as described herein, may be implemented. It is noted that any boxes that are represented by broken or dashed lines in the simplified computing device 1200 shown in FIG. 12 represent alternate implementations of the simplified computing device. As described below, any or all of these alternate implementations may be used in combination with other alternate implementations that are described throughout this document.

The simplified computing device 1200 is typically found in devices having at least some minimum computational capability such as personal computers (PCs), server computers, handheld computing devices, laptop or mobile computers, communications devices such as cell phones and personal digital assistants (PDAs), multiprocessor systems, microprocessor-based systems, set top boxes, programmable consumer electronics, network PCs, minicomputers, mainframe computers, and audio or video media players.

To allow a device to realize the microphone placement implementations described herein, the device should have a sufficient computational capability and system memory to enable basic computational operations. In particular, the computational capability of the simplified computing device 1200 shown in FIG. 12 is generally illustrated by one or more processing unit(s) 1210, and may also include one or more graphics processing units (GPUs) 1215, either or both in communication with system memory 1220. Note that that the processing unit(s) 1210 of the simplified computing device 1200 may be specialized microprocessors (such as a digital signal processor (DSP), a very long instruction word (VLIW) processor, a field-programmable gate array (FPGA), or other micro-controller) or can be conventional central processing units (CPUs) having one or more processing cores and that may also include one or more GPU-based cores or other specific-purpose cores in a multi-core processor.

In addition, the simplified computing device 1200 may also include other components, such as, for example, a communications interface 1230. The simplified computing device 1200 may also include one or more conventional computer input devices 1240 (e.g., touchscreens, touch-sensitive surfaces, pointing devices, keyboards, audio input devices, voice or speech-based input and control devices, video input devices, haptic input devices, devices for receiving wired or wireless data transmissions, and the like) or any combination of such devices.

Similarly, various interactions with the simplified computing device 1200 and with any other component or feature of the microphone placement implementation, including input, output, control, feedback, and response to one or more users or other devices or systems associated with the microphone placement implementation, are enabled by a variety of Natural User Interface (NUI) scenarios. The NUI techniques and scenarios enabled by the microphone placement implementation include, but are not limited to, interface technologies that allow one or more users user to interact with the microphone placement implementation in a "natural" manner, free from artificial constraints imposed by input devices such as mice, keyboards, remote controls, and the like.

Such NUI implementations are enabled by the use of various techniques including, but not limited to, using NUI information derived from user speech or vocalizations captured via microphones or other input devices 1240 or system sensors. Such NUI implementations are also enabled by the use of various techniques including, but not limited to, information derived from system sensors 1205 or other input devices 1240 from a user's facial expressions and from the positions, motions, or orientations of a user's hands, fingers, wrists, arms, legs, body, head, eyes, and the like, where such information may be captured using various types of 2D or depth imaging devices such as stereoscopic or time-of-flight camera systems, infrared camera systems, RGB (red, green and blue) camera systems, and the like, or any combination of such devices. Further examples of such NUI implementations include, but are not limited to, NUI information derived from touch and stylus recognition, gesture recognition (both onscreen and adjacent to the screen or display surface), air or contact-based gestures, user touch (on various surfaces, objects or other users), hover-based inputs or actions, and the like. Such NUI implementations may also include, but are not limited to, the use of various predictive machine intelligence processes that evaluate current or past user behaviors, inputs, actions, etc., either alone or in combination with other NUI information, to predict information such as user intentions, desires, and/or goals. Regardless of the type or source of the NUI-based information, such information may then be used to initiate, terminate, or otherwise control or interact with one or more inputs, outputs, actions, or functional features of the microphone placement implementations.

However, it should be understood that the aforementioned exemplary NUI scenarios may be further augmented by combining the use of artificial constraints or additional signals with any combination of NUI inputs. Such artificial constraints or additional signals may be imposed or generated by input devices 1240 such as mice, keyboards, and remote controls, or by a variety of remote or user worn devices such as accelerometers, electromyography (EMG) sensors for receiving myoelectric signals representative of electrical signals generated by user's muscles, heart-rate monitors, galvanic skin conduction sensors for measuring user perspiration, wearable or remote biosensors for measuring or otherwise sensing user brain activity or electric fields, wearable or remote biosensors for measuring user body temperature changes or differentials, and the like. Any such information derived from these types of artificial constraints or additional signals may be combined with any one or more NUI inputs to initiate, terminate, or otherwise control or interact with one or more inputs, outputs, actions, or functional features of the microphone placement implementations.

The simplified computing device 1200 may also include other optional components such as one or more conventional computer output devices 1250 (e.g., display device(s) 1255, audio output devices, video output devices, devices for transmitting wired or wireless data transmissions, and the like). Note that typical communications interfaces 1230, input devices 1240, output devices 1250, and storage devices 1260 for general-purpose computers are well known to those skilled in the art, and will not be described in detail herein.

The simplified computing device 1200 shown in FIG. 12 may also include a variety of computer-readable media. Computer-readable media can be any available media that can be accessed by the computing device 1200 via storage devices 1260, and include both volatile and nonvolatile media that is either removable 1270 and/or non-removable 1280, for storage of information such as computer-readable or computer-executable instructions, data structures, program modules, or other data.

Computer-readable media includes computer storage media and communication media. Computer storage media refers to tangible computer-readable or machine-readable media or storage devices such as digital versatile disks (DVDs), blu-ray discs (BD), compact discs (CDs), floppy disks, tape drives, hard drives, optical drives, solid state memory devices, random access memory (RAM), read-only memory (ROM), electrically erasable programmable read-only memory (EEPROM), CD-ROM or other optical disk storage, smart cards, flash memory (e.g., card, stick, and key drive), magnetic cassettes, magnetic tapes, magnetic disk storage, magnetic strips, or other magnetic storage devices. Further, a propagated signal is not included within the scope of computer-readable storage media.

Retention of information such as computer-readable or computer-executable instructions, data structures, program modules, and the like, can also be accomplished by using any of a variety of the aforementioned communication media (as opposed to computer storage media) to encode one or more modulated data signals or carrier waves, or other transport mechanisms or communications protocols, and can include any wired or wireless information delivery mechanism. Note that the terms "modulated data signal" or "carrier wave" generally refer to a signal that has one or more of its characteristics set or changed in such a manner as to encode information in the signal. For example, communication media can include wired media such as a wired network or direct-wired connection carrying one or more modulated data signals, and wireless media such as acoustic, radio frequency (RF), infrared, laser, and other wireless media for transmitting and/or receiving one or more modulated data signals or carrier waves.

Furthermore, software, programs, and/or computer program products embodying some or all of the various microphone placement implementations described herein, or portions thereof, may be stored, received, transmitted, or read from any desired combination of computer-readable or machine-readable media or storage devices and communication media in the form of computer-executable instructions or other data structures. Additionally, the claimed subject matter may be implemented as a method, apparatus, or article of manufacture using standard programming and/or engineering techniques to produce software, firmware, hardware, or any combination thereof to control a computer to implement the disclosed subject matter. The term "article of manufacture" as used herein is intended to encompass a computer program accessible from any computer-readable device, or media.

The microphone placement implementations described herein may be further described in the general context of computer-executable instructions, such as program modules, being executed by a computing device. Generally, program modules include routines, programs, objects, components, data structures, and the like, that perform particular tasks or implement particular abstract data types. The microphone placement implementations may also be practiced in distributed computing environments where tasks are performed by one or more remote processing devices, or within a cloud of one or more devices, that are linked through one or more communications networks. In a distributed computing environment, program modules may be located in both local and remote computer storage media including media storage devices. Additionally, the aforementioned instructions may be implemented, in part or in whole, as hardware logic circuits, which may or may not include a processor.

Alternatively, or in addition, the functionality described herein can be performed, at least in part, by one or more hardware logic components. For example, and without limitation, illustrative types of hardware logic components that can be used include field-programmable gate arrays (FPGAs), application-specific integrated circuits (ASICs), application-specific standard products (ASSPs), system-on-a-chip systems (SOCs), complex programmable logic devices (CPLDs), and so on.

The foregoing description of the microphone placement implementations have been presented for the purposes of illustration and description. It is not intended to be exhaustive or to limit the claimed subject matter to the precise form disclosed. Many modifications and variations are possible in light of the above teaching. Further, it should be noted that any or all of the aforementioned alternate implementations may be used in any combination desired to form additional hybrid implementations of the microphone placement implementation. It is intended that the scope of the invention be limited not by this detailed description, but rather by the claims appended hereto. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims and other equivalent features and acts are intended to be within the scope of the claims.

What is claimed is:

1. A process, comprising:

receiving microphone signals of sound received from two or more microphones on a device;

determining sound source locations relative to the device using the placement of two or more microphones on surfaces of the device and time of arrival and amplitude differences of sound received by the microphones;

dividing the space around the device into partitions using the determined sound source locations;

determining the number and type of applications for which the microphone signals are to be used and the number and type of output signals needed; and using the determined partitions to select and process the microphone signals from desired partitions to approximately optimize signals for output to the determined one or more applications.

2. The process of claim 1 wherein dividing the space around the device into partitions further comprises:

from the direction of each microphone obtaining a subspace such that the time of arrival differences for sound from the subspace to the other microphones is greater than 0;

dividing each subspace into three additional subspaces based on the amplitude differences between the microphones;

combining common subspaces so that there are no overlapping subspaces;

combining the subspaces into a number of desired subspaces that contain desired subspace signals; and outputting the desired subspace signals for the combined subspaces for use with the one or more applications.

3. The process of claim 1 wherein dividing the space around the device into partitions further comprises:

determining if an amplitude difference between the microphones is greater than a positive threshold, less than a negative threshold or between the positive threshold and the second negative threshold.

4. The process of claim 3, further comprising determining a source signal in one or more partitions via a binary, a time-invariant or an adaptive solution.

5. The process of claim 3, further comprising determining a subspace signal in one or more partitions, wherein coefficients of the subspace signal are obtained by using a probabilistic classifier that minimizes distortion of the subspace signal.

6. The process of claim 1, wherein the number of applications is determined by determining the number of applications that run simultaneously and multiplying the determined number of applications by the outputs required for each application.

7. The process of claim 1, wherein the signals output to the determined one or more applications are approximately optimized to perform noise reduction in a communications application.

8. The process of claim 1, wherein the signals output to the determined one or more applications are approximately optimized to perform noise reduction in a speech recognition application.

9. The process of claim 1, wherein the signals output to the determined one or more applications are approximately optimized to correct incorrectly perceived sound source directions.

10. A device, comprising:

a front-facing surface, a back-facing surface, a left-facing surface, a right-facing surface, a top-facing surface and bottom facing surface;

one microphone on one surface and another microphone on an opposing surface, wherein there is a distance between the two microphones measured from left to right when viewed from the surface having one of the microphones, the microphones generating audio signals in response to one or more external sound sources;

an audio processor configured to receive the audio signals from the microphones and determine the directions of the one or more external sound sources using their positioning on the surfaces of the device and time of arrival differences and amplitude differences between signals received by the microphone, wherein the sound source directions are determined by whether a time of arrival difference for a signal from one microphone to the other microphone is greater than a positive threshold, less than a negative threshold, or between the positive threshold and the negative thresholds.

11. The device of claim 10, wherein the distance between the microphones is greater than a thickness of the device measured as the smallest distance between the two opposing surfaces.

12. The device of claim 10, further comprising determining the sound source directions by determining whether a time of arrival difference for a signal from one microphone to the other microphone is greater than a positive threshold, less than a negative threshold, or between the positive threshold and the negative threshold.

13. The device of claim 10, further comprising determining the directions by determining if an amplitude difference between the microphones is greater than a positive threshold, less than a negative threshold or between the positive threshold and the second negative threshold.

14. The device of claim 1, further comprising additional microphones in the surfaces that increase a maximum number of sound source directions relative to the surfaces that can be determined.

15. A device comprising:

a front-facing surface, a back-facing surface, a left-facing surface, a right-facing surface, a top-facing surface and a bottom facing surface; and one microphone on one surface and another microphone on an adjacent surface, wherein one of the microphones is offset such that it is closer to a surface of the device that is orthogonal to both of the surfaces containing the microphones, the microphones generating audio signals in response to one or more external sound sources;

an audio processor configured to receive the audio signals from the microphones and determines the direction of the one or more external sound sources in terms of the surfaces of the device by dividing the space around the device into partitions.

16. The device of claim 15, wherein the direction of the sound relative to the surface is determined by using amplitude differences between signals generated by the microphones, and by using the time of arrival differences from the sound of an external sound source to the respective microphones.

17. The device of claim 16, wherein if the amplitude is substantially the same in both microphones, and the time of arrival is sooner in a first one the microphones, then the sound source is directed towards an adjacent surface that is orthogonal to both of the surfaces containing the microphones, and wherein the adjacent surface is also closer to the first microphone.

18. The device of claim 16, wherein if the amplitude is greater in a first one of the microphones, the time of arrival difference between the microphones is smaller than a threshold, and the time of arrival is sooner for the first microphone, then the sound source is directed towards a surface containing the first microphone.

19. The device of claim 16, wherein if the amplitude is greater in a first one of the microphones, the time of arrival difference between the microphones is greater than a threshold, and the time of arrival is sooner for the first microphone, then the sound source is directed towards a surface opposite to the surface containing the other microphone.

20. The device of claim 15, wherein the distance between the microphones is greater than a thickness of the device measured as the smallest distance between two opposing surfaces.

* * * * *